United States Patent [19]

Görike

[11] 4,256,922

[45] Mar. 17, 1981

[54] STEREOPHONIC EFFECT SPEAKER ARRANGEMENT

[76] Inventor: Rudolf Görike, Sternwartstrasse 57c, Vienna 18, Austria

[21] Appl. No.: 20,713

[22] Filed: Mar. 15, 1979

[30] Foreign Application Priority Data

Mar. 16, 1978 [AT] Austria ..... 1870/78
May 8, 1978 [AT] Austria ..... 3315/78

[51] Int. Cl.[3] ..... H04S 1/00

[52] U.S. Cl. ..... 179/1 GA; 179/1 G; 179/1 E; 181/144

[58] Field of Search ..... 179/1 GA, 1 G, 1 E, 179/1 J; 181/144, 153, 154

[56] References Cited

U.S. PATENT DOCUMENTS

| | | | |
|---|---|---|---|
| 3,016,424 | 1/1962 | Franke | 179/1 G |
| 4,006,308 | 2/1977 | Pönsgen | 181/154 |
| 4,058,675 | 11/1977 | Kobayashi et al. | 179/1 GA |
| 4,073,365 | 2/1978 | Johnson | 181/154 |
| 4,133,975 | 1/1979 | Barker | 179/1 GA |

FOREIGN PATENT DOCUMENTS

| | | | |
|---|---|---|---|
| 2140926 | 3/1973 | Fed. Rep. of Germany | 179/1 E |
| 2525705 | 12/1976 | Fed. Rep. of Germany | 179/1 E |

*Primary Examiner*—Douglas W. Olms
*Attorney, Agent, or Firm*—McGlew and Tuttle

[57] ABSTRACT

A device for reproducing acoustic events carried on at least two channels, in a room with at least two sidewalls, comprising, at least one first sound-radiating transducer positioned to radiate sound toward a listener with at least two second sound-radiating transducers positioned in association with the first sound-radiating transducer and for radiating sound toward the at least two sidewalls, respectively. The two channels carrying the acoustic event are supplied to the first and second transducers so that the first transducer receives both channels and each of the second transducers receives one of the two channels. The listener thus receives sound waves from the two second transducers with delay. A delay device may also be connected to the two second sound transducers for producing an additional delay in the first and second channels supplied thereto.

14 Claims, 17 Drawing Figures

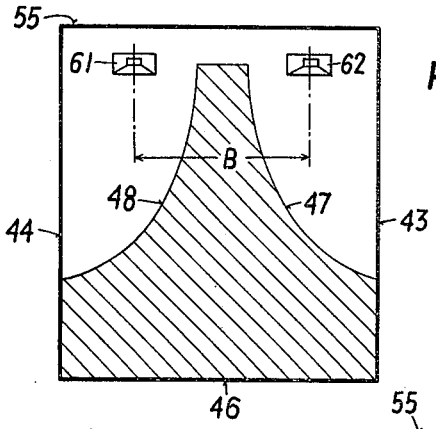
FIG. 5 (PRIOR ART)
FIG. 6
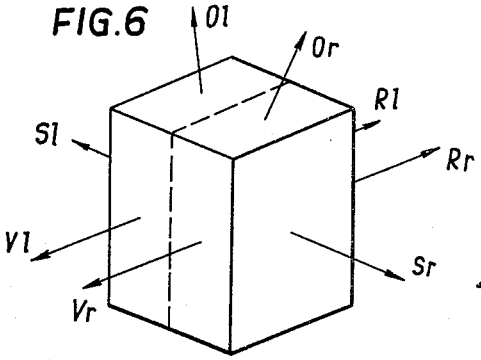
FIG. 7
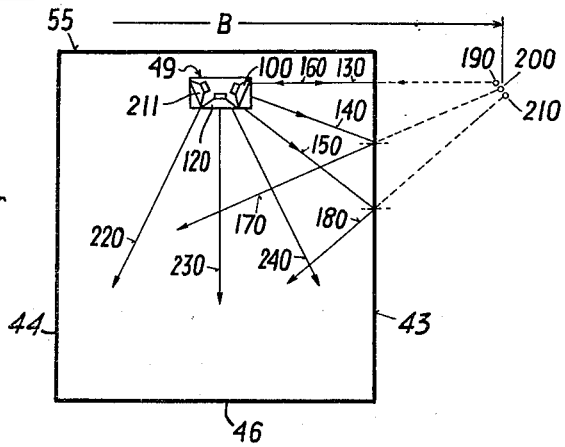
FIG. 8
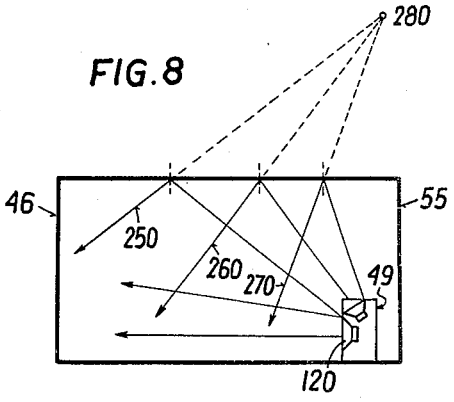
FIG. 9
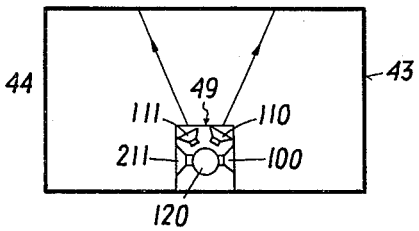
FIG. 10
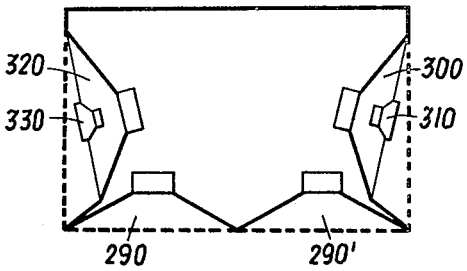
FIG. 11
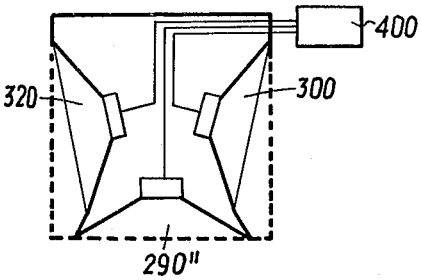

STEREOPHONIC EFFECT SPEAKER ARRANGEMENT

FIELD AND BACKGROUND OF THE INVENTION

The present invention relates to sterophonic sound reproducing devices in general and, in particular, to a new and useful sterophonic effect speaker arrangement which faithfully reproduces the acoustic dynamics of a sound event, such as the playing of an orchestra within a large concert hall.

DESCRIPTION OF THE PRIOR ART

It is well-known that in normal dwelling rooms, having dimensions on the order of magnitude of a few meters, the reproduction of sounds produced by a large body, for example, a big orchestra, is unsatisfactory at the present time.

The conventional use of two loudspeaker units placed at spaced stereo-base locations seldom produces the desired three-dimensional sound effect. It is further difficult in most instances to appropriately arrange two loudspeaker boxes among the furniture, especially if a common level for the boxes is sought. The auditory sensations caused by the standard placement of loudspeakers are due to the effect of a sum localization based on intensity differences. This effect provides a poor reproduction of the acoustic phenomena and sound effects produced in a large room, such as a concert hall. Since the loudspeakers are turned in the direction of the listeners, the interaural signals depend on level differences and the time shift of the stereo signals and determine the direction of a phantom sound source. With a short stereo base possible in apartments, small deviations from the region of the base angle already cause a loss of the stereo effect and bring the law of the first wave front to bear. By moving in front of the loudspeakers, the changes in level and phase are perceived.

In order to improve stereo reproduction, loudspeaker boxes have been developed in which the loudspeakers radiate in various directions, including backwardly. This makes the sound impression more diffuse or dispersed, due to reflections of sound on the closely adjacent walls in the vicinity of the loudspeaker box. As before, however, to obtain a stereophonic transmission, two boxes are necessary which, in addition, must be placed close to at least one wall of the room. Preferably, such boxes are located in the corners of the room, but this is sometimes not possible, as mentioned above.

SUMMARY OF THE INVENTION

The invention is directed to an arrangement for the reproduction of acoustic events transmitted through at least two channels, which not only produces a three-dimensional impression largely corresponding to the original, but also does not raise any problems in the placement of the arrangement in apartments.

Accordingly, an object of the present invention is to provide a stereophonic effect speaker arrangement for reproducing acoustic events in rooms having two sidewalls and particularly events transmitted through at least two channels, comprising, at least two loudspeaker means for radiating sound in at least two directions, located close to one another, with at least two loudspeaker means for every two channels transmitting the acoustic event to be reproduced with at least one of said loudspeakers positioned to radiate sound toward one of the sidewalls to cause the sound to be reflected off the sidewall and delay its reaching a listener in a room.

It results therefrom that in contradistinction to the prior art arrangements, the inventive arrangement reproducing acoustic events, for example, by stereophonic transmission, requires only one loudspeaker box or the like, which can be placed anywhere in the room. It thus need not be located closely adjacent reflecting walls. It is even advantageous to place the inventive loudspeaker combination at a location widely spaced from the walls of the room, to obtain reflections on the walls and to thereby mirror sound sources creating the impression of an enlargement of the base of the acoustic event, with the time delay of the reflected wave being also of some importance, particularly if a frontally radiating loudspeaker or a corresponding loudspeaker group is provided in addition.

Since, however, it is not always possible, in view of available space, to have the loudspeaker combination spaced from the reflecting walls by a distance sufficient to obtain an appreciable time delay substantially contributing to the improvement of the inventive effect, it is provided that, in such cases, delay means are connected to at least one of the transducers to artificially delay the signal emitted therefrom. An enlargement of the auditory panorama is thus obtained, as compared to the conventional arrangement of two loudspeakers on a stereo base, and a limitation to the narrow hearing zone of the conventional stereo technique is prevented. At least two, and preferably three, directions of propagation of sound waves from sound transducers placed at a single location or combined in a constructional unit are provided. One of these propagates sound in the frontal direction, while at least two sound transducers, fed with the righthand and lefthand signals, point in the direction of side limiting walls of the room.

Along with the associated frontal transducer, the laterally radiating transducers determine the direction of the laterally incident sound component resulting from the sum localization. The acoustic events transmitted by the righthand and lefthand channels and exhibiting a difference in level and even a minimum of time delay again combine to form the final auditory sensation. The possibility also arises of producing various effects by controlling the time delay, level differences and/or response differences. If the laterally radiating sound transducers are operated at a higher level relative to the frontal transducer, the auditory perception becomes larger.

If, in addition, and in conformity with principles known per se, certain frequency ranges are attenuated or emphasized, the auditory sensation may be displaced forwardly or upwardly. Since the invention substantially depends on the influence of the sound waves reflected from the walls of the room, it is necessary to compensate for the absorption of the sound waves on sound-absorbing objects. This is done by accentuating the high frequency ranges, with the aid of electrical means provided in the loudspeaker unit or in the electronic device, or even by remote control by ultrasound or infrared. The level may also be adjusted to any value in this way. In accordance with a development of the invention, sound transducers may radiate in addition in the direction of the ceiling or the wall behind the loudspeaker unit.

The interaural time differences and sound pressure level differences which are determining for directional and distance hearing are evaluated by the ears differently, depending on the frequency range. Time delays of carrier oscillations of the aural signals are effective only if the signals do not contain components in excess of 1.6 kHz. Sound pressure level differences and interaural envelope curve displacements are effective if substantial components in excess of 1.6 kHz are present. Information on these substantial facts may be found, for example, in the publication "Räumliches Hören" (Three-dimensional Hearing) by Jens Blauert, publisher S. Hirzel, Stuttgart, 1974, where many references are also indicated.

Due to the great number of parameters, i.e., the sound pressure level of the transducers radiating in different directions, the frequency response of these sound transducers, the directional characteristic of the transducers depending on the frequency, the main direction of radiation of the transducers, and the arrangement of the transducers in the loudspeaker unit, the invention makes it possible to meet a great variety of requirements as to the dimensions and configuration of the room, the absorption conditions created by draperies, furniture, etc., the absorption capacity of the walls and individual tuning, in accordance with the taste of the listener.

Electronic and/or acoustic measures are provied for tuning, within wide limits. This may be done during the installation of the loudspeaker, or with control elements on the loudspeaker, in the circuit of the electronic device, or by remote control, during sound reproduction. The invention is suitable for application to any device for reproducing music, broadcasted or picked-up from discs or tapes, to electronic musical instruments or television sets, and even to portable solid-state receivers which have hitherto been equipped with two frontal loudspeakers, for transmitting stereo signals.

Another embodiment of the invention which is relatively inexpensive and of a simple design and is therefore applied to a two-channel stereo system and is particularly suitable for small rooms, provides that the signal coming from the righthand channel is supplied without delay to at least one frontal loudspeaker and with delay to at least one radiating loudspeaker which faces laterally to the right. This speaker is preferably directed obliquely against the righthand wall of the room, as viewed by the listener. Further, the lefthand channel is designed analogously with another speaker facing to the left.

In accordance with the invention, the loudspeakers of both channels and the frontal loudspeaker or loudspeakers are, of course, assembled in a single constructional unit, for example, a box with frontal and lateral loudspeakers. With some additional expenses, each frontal loudspeaker provided for one channel may be replaced by a loudspeaker group comprising a woofer, a mid-range speaker, and a tweeter, with one loudspeaker group receiving the undelayed signal of one channel and the other group receiving the undelayed signal of the other channel. In this design, one woofer may be saved if the other is supplied with the sum information from the righthand and lefthand channels.

Since, as a rule, high-quality woofers are expensive, the just-mentioned design may reduce the manufacturing costs of an inventive loudspeaker arrangement. This does not result in any acoustical disadvantage since low frequencies at any rate do not contribute to the stereophonic hearing. Since they are substantially non-directional, it therefore suffices to provide only mid-range loudspeakers and tweeters for the radiation to the sides and perhaps also toward the ceiling, without the risk of impairing the quality of reproduction. The frequency response of the woofer may then be limited to a range below an upper limit of 300 Hz to 400 Hz.

To be able to easily adapt the inventive loudspeaker arrangement to the conditions of the room, it is advantageous to make the laterally radiating and possibly also the upwardly radiating loudspeakers, which are supplied with delayed signals, pivotable or adjustable. For this purpose, these loudspeakers may be accommodated, for example, in a spherical housing which is permeable to sound in its portion associated with the diaphragm and mounted for rotation in the sidewall of a loudspeaker box. However, the lateral loudspeakers may also be mounted on pivoting arms which, in turn, are secured to the housing of the frontal loudspeakers.

To obtain the effect sought by the invention to as large an extent as possible, the laterally radiating loudspeakers should have a maximum possible directivity, i.e., their directive pattern should be a very narrow lobe with few secondary maxima. This may be obtained either by a plurality of closely adjacent loudspeakers driven in phase or with loudspeakers having a large diaphragm surface, for example, electrostatic transducers, or by means of a phase-shifting acoustic delay line connected to the rear of the transducer.

To delay the transition time to the laterally radiating loudspeakers, it is advantageous to employ appropriate means of modern electronics, for example, a bucket-brigade line permitting, in practice, to produce any delay in an analog signal. The digital technique may also be applied, but at present, it appears that the bucket-brigade line is more suitable since it is commercially available as an integrated circuit (IC). The delay time should preferably be variable, for example, between 20 and 60 ms, to compensate for asymmetric reflections on the sidewalls caused by an asymmetric disposition of the inventive arrangement in a room and/or by an unequal reflectivity of the walls of the room, or even to adapt it to the personal taste of the listener.

The present invention is preferably intended for two-channel stereo systems, but it offers acoustic advantages even if operated with a compatible monosignal where lefthand and righthand information is absent. Due to the adjustable delay, the sound components reflected from the walls of the room simulate a stereo effect, i.e., a kind of pseudostereophony is obtained.

However, the invention is also suitable for systems comprising more than two channels, for example, for quadrophony. Instead of four single loudspeaker arrangements, in most instances placed in the corners of the room, only two are needed which are preferably disposed centrally at two opposite limiting walls. This substantially reduces the costs of a quadrophonic system and simplifies the dispostion.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 5 is a top plan diagrammatical view showing the sound distribution effect of a conventional two-channel stereo reproduction arrangement;

FIG. 6 is a top perspective schematic representation of the arrangement of sound transducers with the sound radiation directions indicated;

FIG. 7 is a top plan view of the inventive speaker arrangement;

FIG. 8 is a side sectional view of the arrangement shown in FIG. 7 with additional speakers in accordance with the invention;

FIG. 9 is a front cross-sectional view of the embodiment shown in FIG. 8;

FIGS. 10 and 11 are top sectional views of the loudspeaker combinations in accordance with the invention;

DESCRIPTION OF THE PREFERRED EMBODIMENTS

Figure 1:
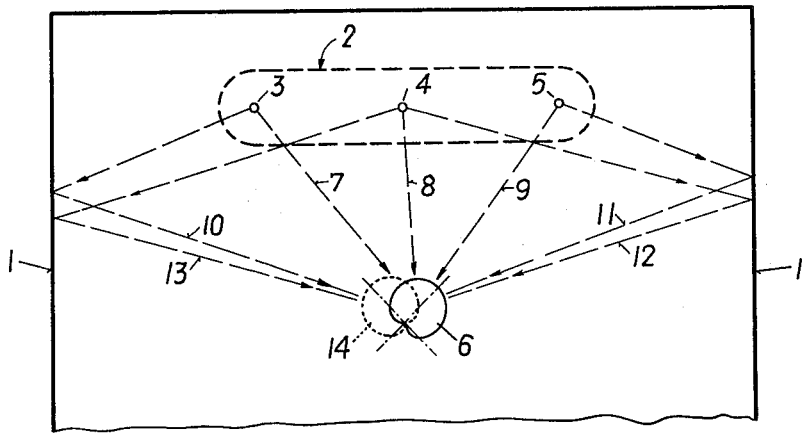
FIG. 1 is a top plan schematic view showing the production of an acoustic event, such as the playing of an orchestra within a concert hall.

For a better understanding of the invention, the relations and interactions of sounds in a conventional two-channel stereo system are explained first. In FIG. 1, it is assumed that a sound-producing body 2, for example, an orchestra, is placed in a large enclosed space, for example, a concert hall having limiting walls 1.

Figure 2:
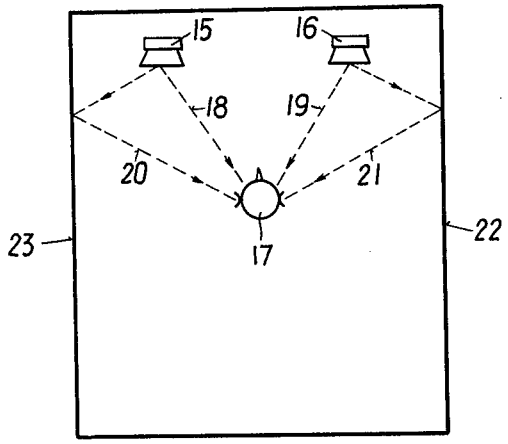
FIG. 2 (PRIOR ART)
FIG. 2 is a top plan view of a Prior Art stereo system utilizing two speakers within a dwelling room.

The direct sound beams 7, 8 and 9 from instruments 3, 4 and 5, produce signals in a microphone 6 corresponding to the directional sensitivity of the microphone. Beams 10, 11, 12 and 13, after being reflected from walls 1 of the hall also furnish signals. The conditions are analogous with respect to a second directional microphone 14. The effective delays of the reflected sound waves are about 20–100 ms, depending on the extension and distance of the hall. The delayed signals are additively mixed with the sound waves in beams 7, 8 and 9, which are only slightly delayed traveling the direct distance between the sound source (3, 4, 5) and the microphones (14, 6). If reproduction of this acoustic event takes place in a substantially smaller room and with loudspeakers positioned as shown in FIG. 2 which, as a rule, corresponds to conditions in an apartment, dwelling or the like, the loudspeakers 15 and 16 furnish the indicated signals for the sum localization perceived by the listener 17. Since the walls 22, 23 of the room are near, the delay of the reflected sound waves 20 and 21, relative to the direct sound waves 18 and 19, is small.

This results in the auditory impression of a small room, which cannot be improved by reverberation either.

Of even greater importance is the fact that the delays of the various signals, which are important for distance and directional perception and which create the impression of the volume of the concert hall or space, are already contained in the additively mixed signals of the microphones. If these signals are supplied to loudspeakers 15, 16, the direct beams 18, 19 and the reflected beams 20, 21 arrive with very small delay differences, because of the small distance from the apartment walls 22 and 23. The spatial information produced by sound in the large hall is thereby lost.

In the conventional loudspeaker installation, the delayed, reflected signals which should reach the listener's ear from the side, are deflected into the frontal direction of the sound beam.

FIG. 5 indicates two loudspeaker boxes 61 and 62 placed in an apartment room having limiting walls 43, 44, 55 and 46. This plan view further indicates the limit lines 47 and 48 within which the sum localization based on intensity differences in the sound, may take place. The stereo base B approximately corresponds to the distance between the listener and the loudspeaker. These restricting conditions are conspicuous particularly if the listener is moving within the room. Sometimes one loudspeaker prevails and sometimes the other prevails, so that the acoustic phenomenon is displaced from one of the loudspeakers to the other.

In accordance with the invention, the compact arrangement of the sound transducers, in which the transducers radiate in different directions, is diagrammatically shown in FIG. 6. The loudspeaker box comprises, so to speak, two parts, of which the righthand part includes any number of sound transducers for the directions front right (Vr), side right (Sr), rear right (Rr) and top right (Or). A mirror-like symmetrical arrangement is provided for the lefthand channel. This complete equipment with sound transducers may also be reduced, without affecting the quality of the invention.

In explanation of the operation of the invention, FIG. 7 shows a loudspeaker box 49 which is placed at any location within the room having limiting walls 43, 44, 55 and 46. The box accommodates, for example, two laterally radiating sound transducers 100, 211 and a sound transducer 120 for frontal radiation. For reasons of clarity, the sound beams of only one of the laterally radiating loudspeakers are indicated. The beams 130, 140 and 150 issuing from radiator 100 are reflected from wall 43 in accordance with the geometric laws of sound propagation. The reflected beams are indicated at 160, 170 and 180. The reflected beams 160, 170 and 180 result in a mirror or phantom sound image from the points 190, 200 and 210 outside of the room. The listener thus has the impression that the sound beams 160, 170 and 180 issue from these mirror sound image points. The sound waves of higher frequency which, due to their short wavelengths, are radiated directionally and focussed, are thereby deflected in such manner that they arrive at the ear of a listener standing at a location spaced from the loudspeaker combination, perpendicularly, whereby, the other ear is separated from the first by the listener's intervening head and the law of the first wave front comes into play.

That is, the aural signals depend on the direction of incidence of the sound waves, because of the properties of the auricle. In addition, the distance between the mirror sound source and the ear is substantially longer than the sound path of the loudspeaker radiation reaching the listener directly in the conventional, standard stereo arrangement. The effective base B of the acoustic phenomena in FIG. 7 is thereby substantially enlarged. These indirect beams combine with beams 220, 230 and 240 issuing from frontal loudspeaker 12. This, however, only applies to a reduced extent, insofar as the sum effect is produced only in the frequency ranges which are common to the two sound radiators. In this embodiment of the invention, the frequency responses of the individual sound transducers are different and the predominant sound level differences become effective. In another embodiment described hereinafter, time delay differences between the laterally radiated and the frontally radiated acoustic events become effective.

FIGS. 8 and 9 relate to loudspeaker combinations for the inventive arrangement, which, in order to further improve the three-dimensional sound effect, are equipped, in addition, with sound transmitters 110 and 111 radiating toward the ceiling of the room. The reflected beams 250, 260 and 270 arriving at the listener produce a phantom source of sound 280. This also enlarges the acoustic signal range beyond the height of the room.

FIG. 10 shows a loudspeaker combination including two frontal radiators 290, 290' for the righthand and lefthand stereo channels. The laterally oriented radiators 300, 310, and 320, 330 are midrange-tweeter systems.

Figure 12:
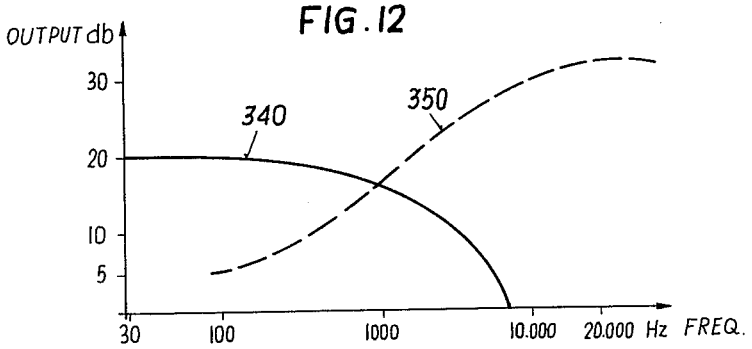
FIG. 12 is a graphical representation of the frequency response for the frontally directed and laterally directed speakers in accordance with the invention.

Through experience with the invention, it has been found that substantial differences in frequency response between the frontal loudspeakers and the lateral radiators are needed to obtain a wide base effect for the acoustic event. It is, at the same time, advantageous if the frequency response of a frontal loudspeaker 290" corresponds to that shown in FIG. 12. This is done with loudspeaker 290" radiating both the right and left signal, as shown in FIG. 11, with the electrical signals connected to each other. Above 1.6 KHz, the level 340 of speaker 290" drops. The laterally radiating transducers 320 and 300 have a level 350 which raises above 1.6 kHz to 30 to 40 db, whereby, the absorption of the sound waves involved in the reflections is compensated.

The electronic device for feeding the various sound transducers may be of any conventional design. For example, a common final stereo amplifier with series-connected filter networks and possibly attenuators or separate output stages for the various loudspeakers or frequency ranges may be provided. The filters and attenuators are connected in advance of the output stages. It is particularly advantageous to provide at the same time for frequency response variations to adapt to the conditions in the apartment. Such an amplifer is illustrated as electronic means 400 is generally shown connected to speakers of FIG. 11 for these purposes.

Figure 3:
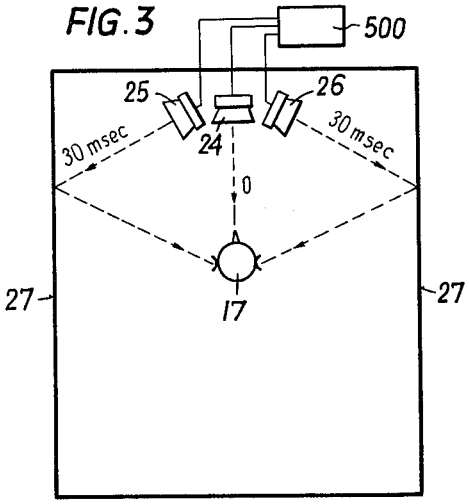
FIGS. 3 and 4 are top plan views showing an arrangement of speakers in accordance with the present invention.

In another embodiment of the invention, to obtain a spatial information corresponding to the volume of the concert or transmitting hall and improving the musical quality of the transmission, a loudspeaker combination is provided, as shown in FIG. 3, comprising individual sound transducers radiating directionally and with unequal delays. In the most simple design, a sound transducer 24 turned in the direction of the listener 17 and two laterally radiating sound transducers 25 and 26 are provided. The laterally radiating transducers are operated with electric signals which are delayed, for example, by 30 msec by using digital or bucket-brigade electronic means, shown at 500. Since the walls in an apartment are very close to the listener, the difference in delay between the direct and indirect sound beams is very small. However, if the laterally radiating transducers are operated to radiate with a delay corresponding to the spacing of walls in a concert hall, aural signals are produced which are similar to the acoustic conditions in a large enclosed space.

The directivity of the loudspeakers is obtained either by the number of closely adjacent sound transducers, or by the superficial extension of the diaphragm, for example, of an electrostatic transducer, or by an acoustic delay element at the back of the transducer diaphragm.

Figure 4:
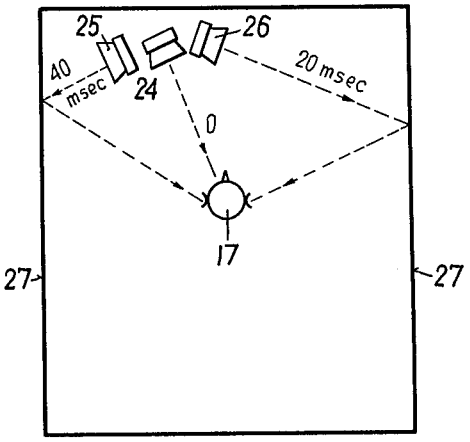

If the loudspeaker arrangement is not placed in symmetrical relationship with the room, as shown in FIG. 4, the delays must be adjusted unequally, for example, to 20 and 40 msec, depending on the spacing from the side walls, in accordance with the invention.

Advantageously, and in addition, the level and frequency response of the individual loudspeakers in means 500 or the like connected to the speakers of FIG. 4, are tuned to conform to the absorption conditions of the room and the furniture.

In particular, the level of the direct signal relative to the reflected sound signal is to be adjusted to a sufficiently low value to counteract the law of the first wave front. This may be accomplished by means of controls on the loudspeaker or at another location of the electrical transmission path, but also by a wireless ultrasound or infrared control.

Figure 13:
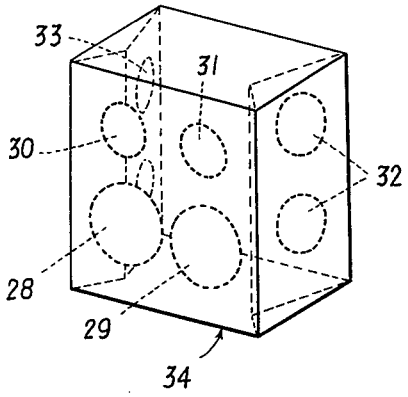
FIGS. 13 through 17 are diagrammatical top front perspective views of speaker arrangements in accordance with the invention.

FIG. 13 shows an embodiment of the invention with two woofers 28 and 29 and two mid-range-tweeter units 30 and 31, for the right and left channels, respectively, and two sets of two laterally radiating mid-range-tweeter units 32 and 33, also for the righthand and lefthand channels, which are mounted somewhat obliquely in loudspeaker box 34. Since the woofers covering 20 to 200 Hz contribute little to the directional and distance hearing, a lateral radiation of the low frequencies can be omitted. It is also possible to electrically unite the signals of the right and left channels and to supply them to only one woofer.

Figure 14:
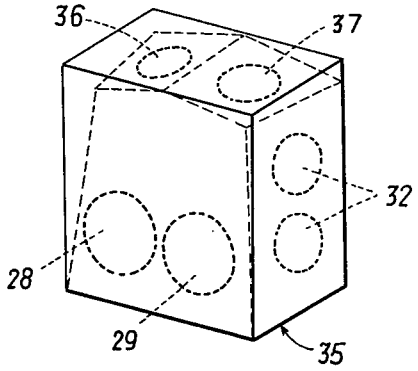
Figure 15:
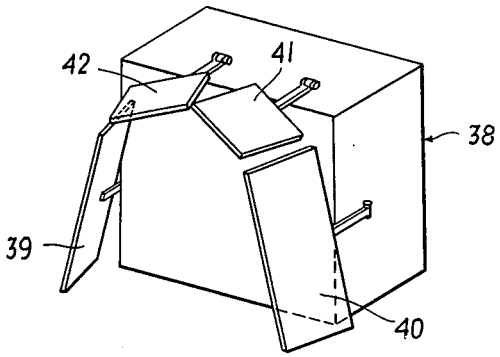

FIG. 14 shows an embodiment of the invention with a loudpeaker box 35 in which, aside from the sound transducers radiating frontally and laterally, two loudspeakers 36 and 37, in inclined position relative to each other, are provided and directed toward the ceiling of the room. These loudspeakers again are operated with time delay, or with an amplitude or frequency response control, depending According to FIG. 15, the laterally and upwardly radiating sound transducers 39, 40, 41 and 42 are pivotally mounted on the loudspeaker box 38, so that any angle relative to the walls of the room may be adjusted. Such a loudspeaker unit may be mounted in a wall bookcase or the like. The distribution of the sound radiators with delayed signals is similar to that of solar cells on satellites.

The pivoting arms may be disengageable from the speaker box 38, so that the sound radiators may be removed and placed at a desired distance from the loudspeaker box, for example, in instances where the reflections on the walls are unsatisfactory due to absorbing surfaces, such as draperies. The time delay sound radiators are then turned in the direction of the listeners.

The individual sound radiators may be operated with unequal time delays relative to each other. The electronic components may also be distributed in the electronic transmission circuitry in any manner. Since at least the frontally radiating loudspeaker and the laterally radiating time-delay sound radiators require separate output amplification stages for the righthand and lefthand channels, these stages may be integrated in the loudspeaker arrangement. Any combination is possible between the two extreme designs, namely, a complete integration of all electronic and acoustic component parts in a single unit, including the high-frequency receiving circuit, the tape recorder and the phonograph unit, and a complete separation of individual single units connected by cables.

The time delay circuitry may be complemented by an artificial reverberation.

Figure 16:
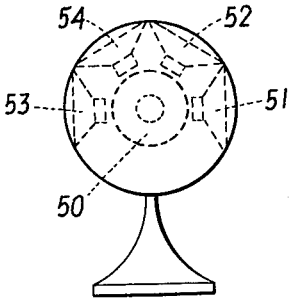

FIG. 16 shows a spherical housing in which the loudspeakers are supplied with stereo signals. A frontal loudspeaker 50 is associated with both the righthand and the lefthand channel, due to electrical interconnection. Sound transducers 51 and 52 are supplied from the righthand channel, and transducers 53 and 54 are supplied from the lefthand channel of the stereo system.

Figure 17:
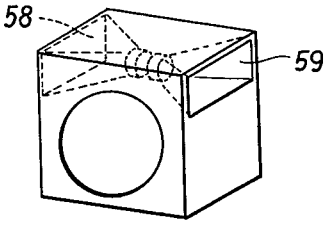

In FIG. 17, the laterally radiating sound transducers in a loudspeaker in accordance with the invention are designed as pressure chamber types with horns, while the transducer for the low frequency range is designed as a cone loudspeaker mounted in the front wall.

In each embodiment, each loudspeaker, transducer of loudspeaker group which radiates in one direction is here termed loudspeaker means.

The inventive arrangement is also suitable for the reproduction of quadrophonic signals. In such an application, one loudspeaker is placed at each of two opposite locations of the room, so that between these locations, a listener will perceive quadrophonic signals. The advantage obtained with the invention is primarily the saving of two loudspeaker boxes and the free choice in the placement of each of the boxes.

While specific embodiments of the invention have been shown and described in detail to illustrate the application of the principles of the invention, it will be understood that the invention may be embodied otherwise without departing from such principles.

What is claimed is:

1. A loudspeaker arrangement for reproducing acoustic events, carried on at least two channels, in a room with at least two sidewalls, comprising a housing at least one first sound-radiating transducer positioned in said housing to radiate sound directly toward a listener, at least two second sound transducers, positioned in said housing for radiating sounds toward the at least two sidewalls, respectively, and means connected to said first and second transducers for supplying the acoustic events carried on said channels to said first and second transducers with one of said channels supplied to one of said second transducers, another of said channels supplied to the other of said second transducers and said another of said channels supplied to said first transducer, whereby, sound from said second transducers reach the listener with a delay with respect to sound reaching the listener from said first transducer.

2. A loudspeaker arrangement for reproducing acoustic events, as claimed in claim 1, further including means connected to said second transducers for delaying the sound emitting therefrom with respect to the sound emitted from said first transducer.

3. A loudspeaker arrangement for reproducing acoustic events of the type transmitted through at least two channels in a room having sound reflecting sidewalls comprising a housing; loudspeaker means mounted in said housing for radiating sound from said housing in at least two directions; said loudspeaker means having at least one loudspeaker for each channel transmitting the acoustic events to be reproduced and for reproducing middle and high range frequencies in the acoustic events to be reproduced being positioned to laterally radiate sound toward one of the sidewalls to cause the sound to be reflected off the sidewall and delay its reaching a listener in the room, and a loudspeaker positioned to radiate sound forwardly; means for controlling the amplitude or frequency response of the loudspeaker of each channel; and delay means operative for delaying the sound radiated from each loudspeaker positioned to laterally radiate sound with respect to sound radiating from said loudspeaker positioned to radiate sound forwardly.

4. An arrangement for reproducing acoustic events, as claimed in claim 3, wherein each of said loudspeakers positioned to laterally radiate sound is operative to laterally radiate sound toward an opposite side wall and symmetrically mirrors each other.

5. An arrangement for reproducing acoustic events, as claimed in claim 3, wherein said loudspeaker means includes at least one further loudspeaker for reproducing middle and high range frequencies in the acoustic events positioned to radiate sound from said housing upwardly and forwardly, and said laterally and upwardly radiating loudspeakers including a spherical housing, a box-like housing provided for the frontally radiating loudspeaker and the spherical housing supported on top of the box-like housing.

6. An arrangement for reproducing acoustic events, as claimed in claim 3, wherein said control means is provided in said housing.

7. An arrangement for reproducing acoustic events, as claimed in claim 3, wherein each loudspeaker connected to different channels has a different frequency response, and the frequency response of said loudspeakers connected to one channel are at least approximately identical to each other.

8. An arrangement for reproducing acoustic events, as claimed in claim 3, wherein said loudspeaker means comprises two identically designed, frontally radiating loudspeaker groups of woofers, middle range loudspeakers and tweeters, of which one group is supplied with an undelayed signal from a right-hand channel and the other is supplied with an undelayed signal from a left-hand channel.

9. An arrangement for reproducing acoustic events, as claimed in claim 3, wherein said loudspeaker means includes at least one loudspeaker which is positioned obliquely to radiate sound upwardly, said delay means being operative to supply said obliquely positioned loudspeaker with time-delayed signals.

10. An arrangement for reproducing acoustic events, as claimed in claim 9, wherein said loudspeaker positioned obliquely of the room is operatively connected to all the channels.

11. An arrangement for reproducing acoustic events, as claimed in claim 3, wherein said loudspeaker means includes loudspeakers positioned to radiate sound laterally or obliquely upwardly and being movably mounted on said housing.

12. An arrangement for reproducing acoustic events, as claimed in claim 8, wherein the operating range of the woofer frontally radiating the undelayed signal ends in the range between 300 Hz and 400 Hz, and the laterally radiating loudspeakers are supplied from their associated channels with delayed signals of higher frequency range.

13. An arrangement for reproducing acoustic events, as claimed in claim 3, wherein said delay means is one of a digital delay line and a bucket-brigade line.

14. An arrangement for reproducing acoustic events, as claimed in claim 13, wherein said delay means includes means for varying the delay time thereof.

* * * * *